US011338829B2

(12) United States Patent
Klingbeil et al.

(10) Patent No.: US 11,338,829 B2
(45) Date of Patent: May 24, 2022

(54) OIL CARRYOVER REDUCTION SYSTEM

(71) Applicant: Transportation IP Holdings, LLC, Norwalk, CT (US)

(72) Inventors: Adam Klingbeil, Ballston Lake, NY (US); Thomas Lavertu, Clifton Park, NY (US); Roy Primus, Niskayuna, NY (US)

(73) Assignee: Transportation IP Holdings, LLC, Norwalk, CT (US)

( * ) Notice: Subject to any disclaimer, the term of this patent is extended or adjusted under 35 U.S.C. 154(b) by 201 days.

(21) Appl. No.: 16/747,081

(22) Filed: Jan. 20, 2020

(65) Prior Publication Data

US 2020/0148235 A1 May 14, 2020

Related U.S. Application Data

(63) Continuation-in-part of application No. 15/334,416, filed on Oct. 26, 2016, now Pat. No. 10,557,430.

(51) Int. Cl.
*B61C 17/12* (2006.01)
*B61C 5/04* (2006.01)
(Continued)

(52) U.S. Cl.
CPC ..... *B61C 17/12* (2013.01); *B61C 5/04* (2013.01); *F02M 23/04* (2013.01); *F02M 26/49* (2016.02)

(58) Field of Classification Search
CPC ..... B61C 17/12; B61C 5/04; F02M 26/49; F02M 23/04
(Continued)

(56) References Cited

U.S. PATENT DOCUMENTS 8,473,127 B2 6/2013 Daum et al.
8,676,410 B2 3/2014 Houpt et al.
(Continued)

FOREIGN PATENT DOCUMENTS

AU 2012261786 A1 1/2013

OTHER PUBLICATIONS

Yang et al.; Design and Application of the Train Operation Optimization Systems of HXN5-Type locomotive; Proceedings of the 2015 International Conference on Electrical Information Technologies for Rail Transportation; Mar. 12, 2016; vol. 337; pp. 759-766.
(Continued)

*Primary Examiner* — Lindsay M Low
*Assistant Examiner* — Omar Morales
(74) *Attorney, Agent, or Firm* — Philip S. Hof

(57) ABSTRACT

A system is provided that includes a controller configured to determine one or more propulsion-generating vehicles in a group of propulsion-generating vehicles that have an increased risk for damage to an engine system based on operation at a fueling level that is less than a designated threshold fueling level for at least a designated time period. The controller is further configured to determine respective power outputs for the propulsion-generating vehicles in the group such that the one or more propulsion-generating vehicles having the increased risk for damage to the engine system do not operate below the designated threshold fueling level for longer than the designated time period.

20 Claims, 4 Drawing Sheets

(51) Int. Cl.
*F02M 23/04* (2006.01)
*F02M 26/49* (2016.01)

(58) Field of Classification Search
USPC ..... 123/196 S
See application file for complete search history.

(56) References Cited

U.S. PATENT DOCUMENTS

| | | | | |
|---|---|---|---|---|
| 8,924,052 | B2 | 12/2014 | Melas et al. | |
| 2007/0272116 | A1 | 11/2007 | Bartley et al. | |
| 2010/0174484 | A1 | 7/2010 | Sivasubramaniam et al. | |
| 2014/0165967 | A1* | 6/2014 | Bucksey | F02B 71/00 123/46 A |
| 2014/0252174 | A1* | 9/2014 | Melas | B61C 17/12 246/187 A |
| 2014/0379180 | A1* | 12/2014 | Kral | B61C 7/04 701/19 |
| 2016/0207550 | A1* | 7/2016 | Raeder | G07C 5/0825 |
| 2016/0208744 | A1* | 7/2016 | Bailey | F02M 26/30 |

OTHER PUBLICATIONS

Franke et al.; An algorithm for the optimal control of the driving trains; Decision and Control, 2000. Proceedings of the 39th IEEE Conference; vol. 3; pp. 2123-2128.

* cited by examiner

OIL CARRYOVER REDUCTION SYSTEM

CROSS-REFERENCE TO RELATED APPLICATIONS

This application is a continuation-in-part of and claims priority to U.S. patent application Ser. No. 15/334,416, filed 26 Oct. 2016, and the entire contents of the foregoing application are incorporated herein by reference.

BACKGROUND

Technical Field

This application includes embodiments that relate to vehicle control operations.

Discussion of Art

Vehicles can be powered by operation of engines that consume fuel and have moving parts (e.g., pistons in cylinders) lubricated by oil. During operation of the engines in certain operational conditions (e.g., low fueling levels or during idle operation where an engine is operating but is not producing power to propel a vehicle), oil intended to lubricate the moving parts of the cylinders of the engine may travel into the combustion chambers of the engine and pool on top of pistons in the cylinders. At least some of this pooled oil may be expelled from the cylinders and/or engine via the flow of exhaust exiting the cylinders. The migration, pooling, and/or expulsion of the oil may be referred to as oil carryover.

Vehicles with systems that treat or re-use the exhaust from the cylinders may be damaged by oil carryover. For example, an exhaust aftertreatment system may include one or more chemical compounds that chemically react with the exhaust to reduce the amount of certain constituents in the exhaust. Exhaust gas recirculation (EGR) systems may recycle at least some of the exhaust and re-introduce the exhaust back into at least some of the cylinders in the engine.

The presence of oil in the exhaust may damage aftertreatment systems, EGR systems, and other engine systems. Sulfur or other constituents in the exhaust due to oil carryover can damage or destroy chemical catalysts used in the aftertreatment systems. Oil in the exhaust can damage or destroy cooling components of the EGR systems that are needed to cool the recirculated portion of the exhaust prior to re-introducing the exhaust back into the cylinders.

One existing attempt to prevent or reduce damage to aftertreatment systems and/or EGR systems from oil carryover includes temporarily increasing the load on the engine. This process heats the exhaust and can burn the oil out of the exhaust. Temporarily increasing the load on the engine significantly increases the amount of fuel consumed by the engine so is not a fuel-efficient manner of reducing or eliminating oil carryover. The increased engine load also increases the amount of oil in the exhaust for a temporary time period, which still can damage or destroy the catalysts in the aftertreatment systems and/or the cooling components of the EGR systems. Additionally, temporarily increasing the engine load can cause a significant amount of oil to be introduced into one or more cylinders of the engine. The oil cannot be easily compressed by the piston in a compression chamber of a cylinder, so the engine itself may be damaged when the piston attempts to compress the air (and oil) in the cylinder.

BRIEF DESCRIPTION

In at least one embodiment, a vehicle control operation system is provided that includes a controller configured to determine one or more propulsion-generating vehicles in a group of propulsion-generating vehicles that have an increased risk for damage to an engine system based on operation at a fueling level that is less than a designated threshold fueling level for at least a designated time period. The controller is further configured to determine respective power outputs for the propulsion-generating vehicles in the group such that the one or more propulsion-generating vehicles having the increased risk for damage to the engine system do not operate below the designated threshold fueling level for longer than the designated time period.

In at least one embodiment, a vehicle control operation method is provided that includes determining one or more propulsion-generating vehicles in a group of propulsion-generating vehicles that have an increased risk for damage to an engine system based on operation at a fueling level that is less than a designated threshold fueling level for at least a designated time period. The method includes determining respective power outputs for the propulsion-generating vehicles in the group such that the one or more propulsion-generating vehicles having the increased risk for damage to the engine system do not operate below the designated threshold fueling level for longer than the designated time period.

In at least one embodiment, a vehicle control operation system is provided that includes a controller configured to determine if a propulsion-generating vehicle has a risk for damage to an exhaust-based system of that vehicle based at least in part on operation of the vehicle at a fueling level that is less than a designated threshold fueling level for at least a designated time period. The exhaust-based system is configured to receive exhaust from an engine of the respective propulsion-generating vehicle. The risk of damage increases over time during the designated time period. The controller is further configured to determine a respective power output for the vehicle so that the vehicle does not operate below the designated threshold fueling level for longer than the designated time period.

BRIEF DESCRIPTION OF THE DRAWINGS

The subject matter may be understood from reading the following description of non-limiting embodiments, with reference to the attached drawings, wherein below.

DETAILED DESCRIPTION

This application includes embodiments that relate to vehicle control operations. Because some vehicle operating modes may increase the risk of damage to engine systems, the inventive embodiments may control vehicle operations to determine which operations, and for what periods, the risk level for damage is acceptable or not acceptable. The control system may then initiate changes to the operation of the vehicle to manage that risk to an acceptable level. Risk of damage to the engine and related components, and associated actual damage, may be reduced or eliminated.

Figure 1:
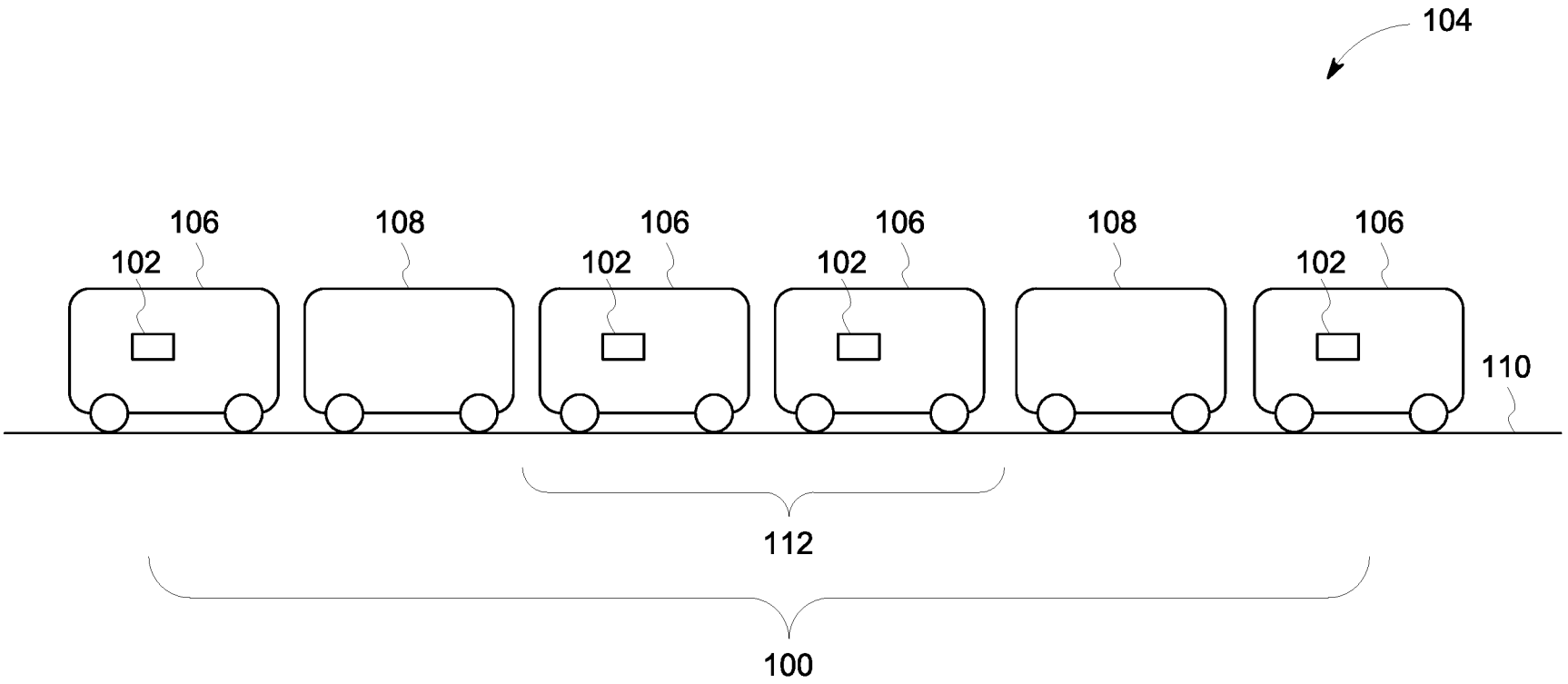
FIG. 1 illustrates one embodiment of a vehicle control system that reduces or eliminates time periods in which vehicles operate under undesirable operating conditions.

FIG. 1 illustrates one embodiment of a vehicle control system 100 that reduces or eliminates risks (and/or damage) associated with time periods in which vehicles operate under undesirable operating conditions. The system includes one or more controllers 102 disposed onboard a vehicle system 104 that is formed from one or more vehicles 106, 108. While the vehicle system is shown as including several vehicles 106, 108, optionally, the vehicle system may include a single vehicle 106 or a different number of the vehicles 106 and/or the vehicles 108. The vehicles 106 are propulsion-generating vehicles having propulsion systems that operate to propel the vehicles 106. Examples of the propulsion-generating vehicles include rail vehicles (e.g., locomotives), automobiles, trucks, marine vessels, aerospace vehicles, mining vehicles, or other off-highway vehicles (e.g., vehicles that are not designed or are not legally permitted to travel on public roadways).

The vehicles 108 are non-propulsion-generating vehicles that do not have propulsion systems for propelling the vehicles 108. Examples of the non-propulsion-generating vehicles 108 include rail vehicles (e.g., rail cars), trailers, barges, or the like. The vehicles 106, 108 may be mechanically coupled with each other (e.g., by couplers), may abut one another during travel, or may be disconnected from each other but communicate with each other to coordinate their movements and, as a result, travel together as the vehicle system 104 moves along a route 110 (e.g., a track, road, waterway, or the like).

The vehicle system 104 can include one or more groups 112 of the vehicles. A group of the vehicles can include a single propulsion-generating vehicle or two or more depending on application specific parameters. In one embodiment, a group of vehicles is two or more adjacent or neighboring propulsion-generating vehicles. These may be adjacent or neighboring when the vehicles are directly coupled with each other (e.g., by couplers connected with each vehicle) and/or when the vehicles are next to each other without any non-propulsion generating vehicles 108 between the adjacent or neighboring propulsive vehicles. A group may be referred to variously as a consist, platoon, fleet or swarm. While only a single group 112 is labeled in FIG. 1, optionally, a vehicle system 104 may have two or more groups.

Figure 2:
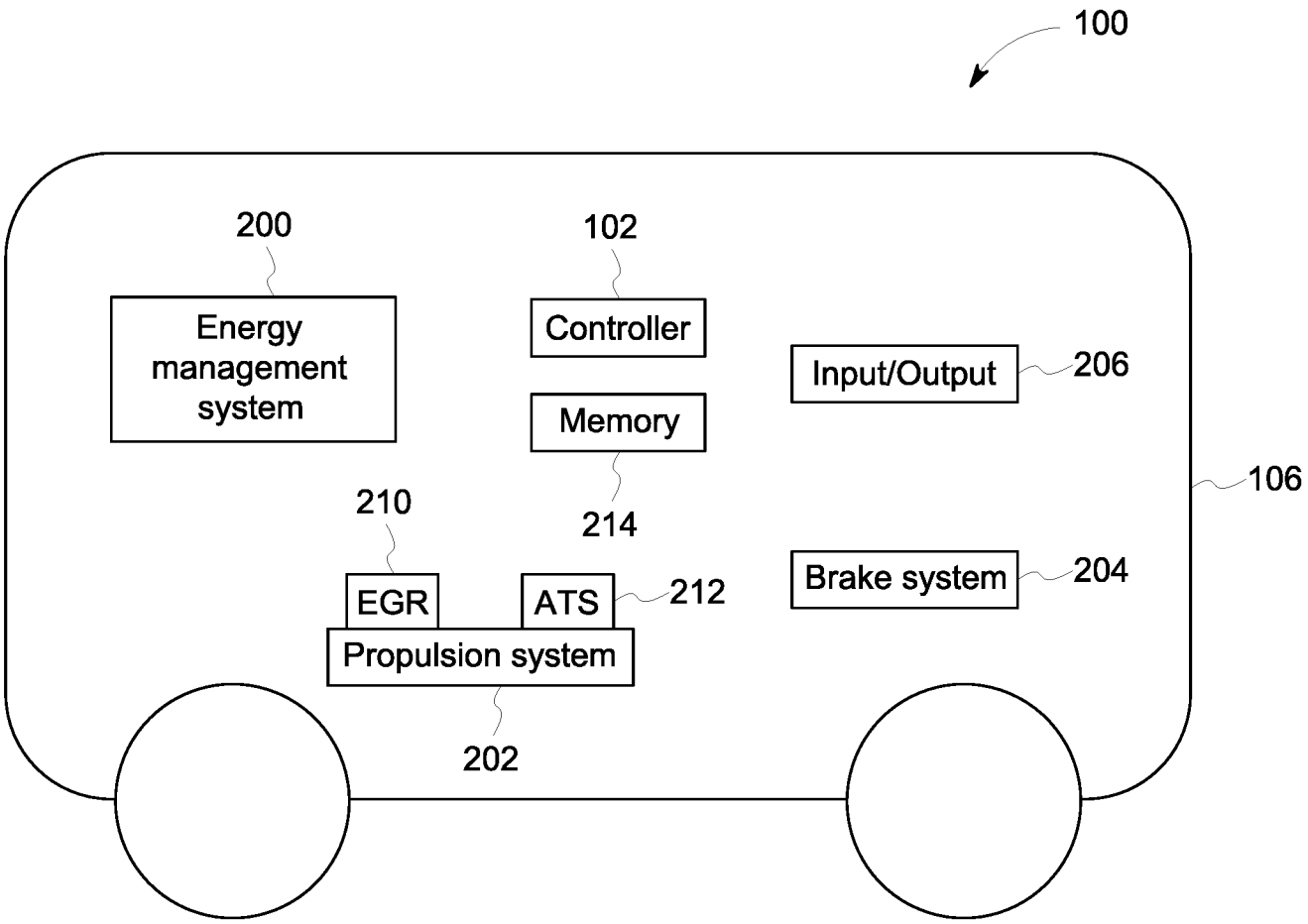
FIG. 2 illustrates one embodiment of the vehicle control system disposed onboard a propulsion-generating vehicle.

FIG. 2 illustrates one embodiment of the vehicle control system 100 disposed onboard one of the propulsion-generating vehicles. The vehicle control system 100 includes the controller 102 and an energy management system 200. The controller 102 represents hardware circuitry that includes and/or is connected with one or more processors (e.g., one or more microprocessors, field programmable gate arrays, and/or integrated circuits) that perform the operations described herein to reduce or eliminate time periods that the vehicle 106 operates in conditions that can damage engine systems (e.g., due to oil carryover).

The controller 102 communicates with a propulsion system 202 of the vehicle 106 via one or more wired and/or wireless connections. The propulsion system 202 represents one or more engines that consume fuel and that include a lubricating fluid (e.g., oil) for operation. The propulsion system 202 optionally can include one or more alternators, generators, motors, turbochargers, or the like, that operate based on operation of the engine. The controller 102 generates and sends control signals to the propulsion system 202 to control the speed at which the engine operates.

The controller 102 communicates with a brake system 204 of the vehicle 106 via one or more wired and/or wireless connections. The brake system 204 represents one or more brakes such as friction brakes, dynamic brakes, air brakes, or the like. The controller 102 generates and sends control signals to the brake system 204 to slow or stop movement of the vehicle 106.

The energy management system 200 represents hardware circuitry that includes and/or is connected with one or more processors (e.g., one or more microprocessors, field programmable gate arrays, and/or integrated circuits) that determine operational settings of the propulsion system 202 and/or the brake system 204 for different locations, times, and/or distances along one or more routes being traveled by the vehicle 106 and/or vehicle system 104 (shown in FIG. 1). The energy management system 200 can determine fueling levels, brake settings, speeds, or the like, at which the propulsion system 202, brake system 204, and/or vehicle 106 is to operate in order to reduce the amount of fuel consumed, reduce the amount of emissions generated, reduce the amount of noise generated, or the like, relative to the propulsion system 202, brake system 204, and/or vehicle 106 operating according to other operational settings (e.g., traveling at an upper speed limit of the routes 110 traveled by the vehicle 106). In one embodiment, the energy management system 200 may operate similar or identical to the trip planner or trip planner device and the operational settings designated by the energy management system 200 may be the trip plan created as described in U.S. Pat. No. 9,162,690, the entire disclosure of which is incorporated herein by reference.

The energy management system 200 can communicate the operational settings to the controller 102 and/or a memory 214 (described below), and the controller 102 may automatically control operation of the propulsion system 202 and/or brake system 204 to implement the operational settings, or optionally may communicate control signals to one or more input/output devices 206 to communicate the operational settings to an operator (who then controls the propulsion system 202 and/or brake system 204 accordingly). The input/output devices 208 can include one or more display devices, touchscreens, keypads, pedals, throttles, levers, etc.

In the illustrated embodiment, the propulsion system 202 is operably coupled with an exhaust gas recirculation system 210 (EGR in FIG. 2) and an exhaust gas aftertreatment system 212 (ATS in FIG. 2). Alternatively, the propulsion system 202 may be coupled with the exhaust gas recirculation system 210 and not the aftertreatment system 212, may be coupled with the aftertreatment system 212 but not the exhaust gas recirculation system 210, or may not be coupled with either of the exhaust gas recirculation system 210 or the aftertreatment system 212.

The exhaust gas recirculation system 210 receives at least some exhaust expelled by cylinders of the engine in the propulsion system 202 and recirculates the received exhaust back into one or more cylinders of the engine in the propulsion system 202. The exhaust gas recirculation system 210 may cool the received exhaust and/or mix the received exhaust with air prior to circulating the exhaust back into the cylinders. The aftertreatment system 212 receives at least some exhaust expelled by cylinders of the engine and treats the received exhaust before directing the treated exhaust into the surrounding atmosphere. For example, the aftertreatment system 212 may chemically react the received exhaust with chemical catalysts to chemically alter the exhaust. This alteration can change the chemicals in the exhaust that are directed into the surrounding atmosphere. As described above, the exhaust gas recirculation system 210 and the aftertreatment system 212 may be damaged or destroyed by the presence of oil in the exhaust exiting the engine of the propulsion system 202.

The memory 214 represents one or more computer-readable media, such as one or more computer hard drives, optical discs, flash drives, read only memories, and/or random-access memories, that store data for use by the controller 102 and/or energy management system 200. The memory 214 can store data indicative of which vehicles are included in the vehicle system 104, which vehicles have one or more aftertreatment systems 212 and/or EGR systems 210, operational settings of the vehicles as designated by the energy management system 200, or the like.

The control system can vary, modify, and/or switch operations of one or more vehicles in the vehicle system to prevent or reduce conditions that are prone to damaging the engine system, including systems that receive the exhaust from the engine. For example, the control system 100 can reduce the amount of time that one or more of the vehicles operate at fueling levels that are more likely to damage the engine system than other fueling levels. This can involve reducing the amount of time that one or more of the vehicles operate at a fueling level that is less than a designated threshold fueling level (e.g. such as an idle setting) to prevent or reduce oil carryover. The engine system can include or represent the aftertreatment system 212, the EGR system 210, a turbocharger, a fuel system, the internal combustion engine itself, an ignition system, an energy storage system, and/or the like. For example, the engine system can represent multiple engine-related components that are operably connected and operate to convert chemical energy to mechanical energy used to drive movement of the vehicle system. The engine system may also refer to specific individual engine-related components, such as the aftertreatment system and the EGR system.

In one embodiment, the controller 102 determines one or more propulsion-generating vehicles in a group of propulsion-generating vehicles that have an increased risk for damage to an engine system thereof. The group of vehicles may be all of the vehicles in the vehicle system 104, or a subset of these vehicles. For example, the group may be a consist of vehicles that are adjacent to each other (e.g., neighbor each other in the vehicle system 104 without being separated by one or more vehicles 104). The risk for damage may involve the risk that the engine system is damaged due to oil present in the engine cylinders and in the exhaust emitted from the engine. The engine system may include or represent an exhaust-based system that receives the exhaust emitted by the engine during internal combustion of fuel and air. The potential damage to the system may include fouling or decomposing of chemical constituents (e.g., catalysts in the aftertreatment systems), decreased or degraded performance of the system (e.g., due to engine mistiming or build-up of deposits on components exposed to the exhaust gas, particularly control valves thus preventing proper operation), shortened life of the system or a component thereof, and physical wear including, for example, scratching, scuffing, deterioration, destruction of system components (e.g., the cooling components of the EGR systems), and the like.

The controller 102 can make this determination by examining the data stored in the memory 214. The data may indicate which vehicles have particular systems that are susceptible to damage or degradation from the presence of oil in exhaust. Such systems can include, for example, the aftertreatment system 212 and/or the EGR system 210. These vehicles may have an increased risk for damage from oil carryover when engines of the vehicles operate at a fueling level that is less than a designated threshold fueling level for at least a designated time period. This time period may be a non-instantaneous duration of time, such as several minutes (e.g., fifteen minutes, ninety minutes, three hundred minutes, etc.). This time period may be determined by examining how long the vehicle 106 (or a vehicle 106 of the same make, model, and/or year of manufacture) can operate less than the designated threshold fueling level before at least a designated amount of oil (e.g., a measurable amount of oil) is present in the exhaust exiting the engine of the propulsion system 202 of the vehicle 106. The fueling level may be an amount or rate of fuel supplied to one or more cylinders of an engine during a combustion cycle or during a longer time period.

In one embodiment, the designated threshold fueling level may be determined experimentally and/or via historical data. In one embodiment, the designated threshold fueling level can be selected by an operator, a fleet manager, or a service shop for the vehicle. In one embodiment, the threshold fueling level may be determined by the controller based on vehicle specifications and operational parameters. If the vehicle 106 operates at fueling levels below the designated threshold fueling level for longer than the designated time period, an increasing and measurable amount of oil may be present in the exhaust exiting the engine of the propulsion system. If the vehicle 106 operates at fueling levels above the designated threshold fueling level and/or at fueling levels below the designated threshold fueling level for a shorter duration than the designated time period, then the exhaust exiting the engine is expected to transport an amount of oil present that is insufficient to cause damage. The range of fueling levels below the designated threshold fueling level may be associated with low power and/or low torque operating conditions (e.g., conditions in which the engine is not being used to accelerate the vehicle along a route). The range of fueling levels below the designated threshold fueling level include an idle setting of the engine in an embodiment. The designated threshold fueling level may be set based on a transient mode for decreased engine loads and/or power levels. The fueling level at the idle setting may be the amount or rate of fuel supplied to an engine during a time period that the engine is operating at idle. During idle operation the engine is operating but is not producing power to propel the vehicle. Another factor is the degree to which the fueling level is lower than the threshold fueling level for the controller determination. Other factors for the controller determination may include the engine type, engine age or wear, the oil/lubrication type, the oil/lubrication age, ambient temperature conditions, ambient pressure (altitude) conditions, oil/lubrication temperature, the health of the engine cylinders and related components, and the like. The rate of oil migration, and oil pooling, in the cylinder and corresponding oil infiltration to the exhaust stream may influence the designated time period calculation. Relatedly, the sensitivity to the presence of oil in the exhaust stream by the engine system is another factor. For example, an engine system with a catalyst or an engine system with an EGR cooler may be relatively more sensitive than an engine system without such components.

The risk of damage may be increased for these vehicles relative to other vehicles that do not have one or more of the engine systems, such as the aftertreatment system 212 or the EGR system 210. For example, not all of the vehicles in the vehicle system 104 or in a consist of the vehicle system 104 may have this increased risk because one or more of the vehicles may not include the aftertreatment system 212 and/or may not include the EGR system 210. Furthermore, some of the vehicles may have different types of engines, and some of the engines may be less prone to oil carryover or other effects than other engines. For example, vehicles that are more prone to oil carryover may have an increased risk for damage to engine systems that receive the exhaust than the vehicles that are less prone to oil carryover. If the collective load on the vehicle group can be apportioned and distributed by the controller and/or energy management system among the plurality of engines such that no "at risk" engine system experiences a "low fueling" operation for longer than the designated time period, then the risk of damage to any particular engine system of the group could be calculated, managed, lowered, and/or eliminated.

The controller 102 also determines a power requirement for one or more groups 112 of vehicles. The power requirement is a total amount of power that the vehicles in a group 112 are to generate at one or more locations along the route 110. This power can be the total amount of tractive effort, propulsive force, torque, or electrical wattage that is to be generated by the propulsion systems 202 of the vehicle 106 or vehicles in the group 112 at one or more locations along the route 110.

The controller 102 can determine the power requirement from information provided by (e.g., received from) the energy management system 200. The energy management system 200 can calculate the amount of power needed to be generated by the propulsion systems 202 of the vehicles in a group 112 in order to propel the group 112 and/or the vehicle system 104 at different locations along the route 110. The amounts of power needed for different locations can be calculated based on the characteristics of the route 110 (e.g., curvature, grade, speed limit, etc.), characteristics of the vehicles and/or vehicle system 104 (e.g., total mass, how much power each propulsion system 202 is capable of generating, etc.), characteristics of the external environment (e.g., wind speed, wind direction, coefficient of friction between the wheels of the vehicles and the route 110, etc.), and/or characteristics of a trip of the vehicle system 104 (e.g., speeds at which the vehicle system 104 is to travel at the different locations, which may be designated by an operator and/or may be the speed limit of the route 110). Optionally, the power requirement for the different locations can be calculated based on operational settings designated by a trip plan for the vehicles along the route. The trip plan may be generated or selected based on the characteristics of the route, the vehicles, the external environment, the scheduled trip, the cargo, the weather, traffic conditions, condition of the route, and/or the like.

For example, for smaller radii of curvature in the route 110, steeper inclines in the route 110, heavier vehicles, faster wind speeds in a direction that is opposite or transverse to a direction of travel of the vehicle system 104, greater coefficients of friction between the wheels of the vehicles and the route 110, and/or faster speeds at which the vehicle system 104 is to travel, the power requirement may be larger when compared to larger radii of curvature in the route 110, smaller inclines (or declines) in the route 110, lighter vehicles, slower wind speeds in the direction that is opposite or transverse to the direction of travel or wind speed in the direction of travel of the vehicle system 104, smaller coefficients of friction between the wheels of the vehicles and the route 110, slower speeds at which the vehicle system 104 is to travel, etc. In an alternative embodiment, the power requirements may be dictated (e.g., set) by an operator of the control system 100. Optionally, the power requirements may be obtained from previous trips of the same or different vehicle system 104 over the same route 110.

The controller 102 determines power outputs for the vehicles in the group 112 for one or more locations along the route 110 based on the power requirements that are determined. The controller 102 may divide the power requirement to be generated by the vehicles in the group 112 along a segment of the route 110 among the vehicles. For example, if three vehicles are included in the group 112, then a power requirement may be divided by directing the propulsion system 202 of a first vehicle 106 to generate thirty percent of the power requirement, by directing the propulsion system 202 of a second vehicle 106 to generate fifty percent of the power requirement, and by directing the propulsion system 202 of a third vehicle 106 to generate twenty percent of the power requirement.

The controller 102 can divide the power requirement among the vehicles in the group 112 such that the total power generated by the group 112 of vehicles 116 meets the power requirement that is determined without the vehicle 106 or vehicles having the increased risk of damage from oil carryover operating at a fueling level associated with the increased risk for at least the designated time period.

Figure 3:
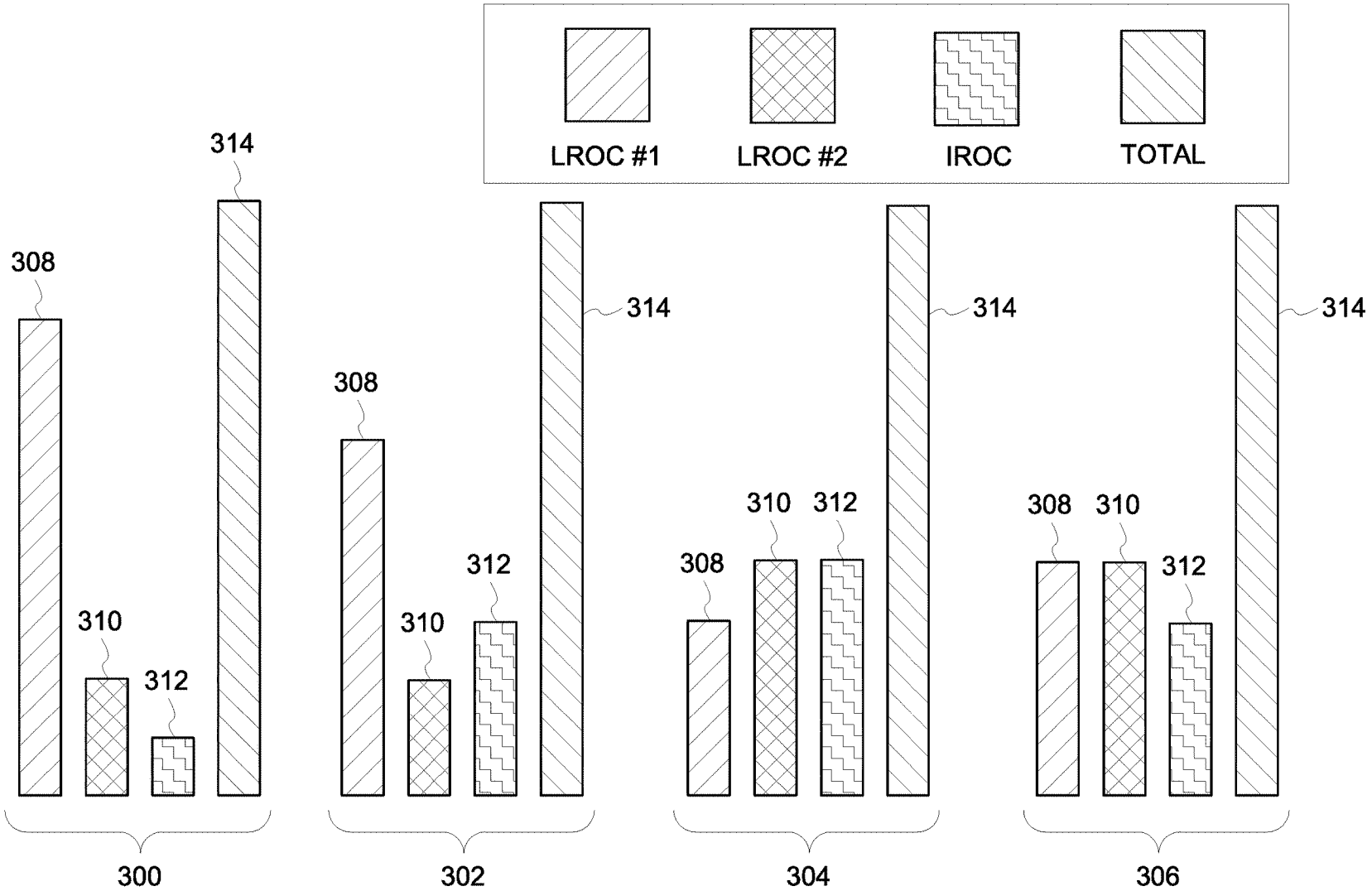
FIG. 3 illustrates examples of different sets of power outputs for propulsion-generating vehicles in a group of the vehicles in a vehicle system.

FIG. 3 illustrates examples of different sets 300, 302, 304, 306 of power outputs 308, 310, 312, 314 for the vehicles in a group 112 of vehicles in the vehicle system 100. Each set 300, 302, 304, 306 represents the power output 308, 310, 312, 314 for a group 112 of three vehicles in the vehicle system 100. Although not shown in FIG. 1, the vehicle system 100 may have a group 112 of three (or a different number of) vehicles. The power outputs 308, 310, 312 represent amounts of tractive effort to be produced by different vehicles in the group 112 and the power output 314 represents the power requirement for the vehicles in the group 112.

For example, in each set 300, 302, 304, 306, the power output 308 can indicate the amount of power (or fueling level) for a first vehicle 106 in the group 112, the power output 310 can indicate the fueling level for a second vehicle 106 in the same group 112, the power output 312 can indicate the fueling level for a third vehicle 106 in the same group 112, and the power output 314 can indicate the power requirement for the group 112 at a designated location along the route 110. The power outputs 308, 310, 312 can indicate respective fueling levels of the vehicles. For example, larger power outputs 308, 310, 312 are associated with larger fueling levels, while smaller power outputs 308, 310, 312 are associated with smaller fueling levels. The association of the fueling level with different power outputs may be stored in the memory 214.

The power outputs 308, 310, 312 in each set 300, 302, 304, 306 represent different potential power outputs or operational settings of the different vehicles. The power outputs 308, 310 can represent the power outputs or operational settings of first and second vehicles, respectively, having a lower risk of oil carryover ("LROC #1" and "LROC #2" in FIG. 3) relative to the third vehicle 106 (having a power output or operational setting represented by the power outputs 312). For example, the third vehicle 106 can include an aftertreatment system 212 and/or EGR system 210, while the first and second vehicles do not include an aftertreatment system 212 or an EGR system 210. The third vehicle 106 can have an increased risk of damage from oil carryover, as indicated by IROC in FIG. 3.

The sets 300, 302, 304, 306 are referred to as an initial set, a revised option A set, a revised option B set, and a revised option C set. The initial set 300 can represent an initial distribution of power outputs 308, 310, 312 among the vehicles in the group 112 as directed or assigned by the energy management system 200. These initial power outputs can be based on fueling levels dictated by the energy management system 200 in order to reduce fuel consumed and/or emissions generated by the vehicle system 104. For example, the initial power outputs can be based on the power requirement that is determined based on a trip plan that designates operational settings of the propulsion-generating vehicles in the group that different for one or more of different times or different locations during a trip of the vehicles in the group along one or more routes. Higher fueling levels may be associated with greater power outputs relative to lower fueling levels.

The controller 102 examines the power outputs 308, 310, 312 of the initial set 300 (e.g., the initial power outputs) and determines whether the power output 312 of the vehicle 106 having the increased risk of oil carryover will result in that vehicle 106 operating at a fueling level that is less than a designated threshold for at least the designated time period described above. For example, the controller 102 can examine the initial power outputs designated by the energy management system 200 for the vehicle 106 having the increased risk of oil carryover at different times to determine whether these power outputs result in that vehicle 106 operating at idle for at least the designated time period. If these initial power outputs would result in the vehicle 106 having the increased risk of oil carryover to operate at idle (e.g., below the designated threshold fueling level) for at least the designated time period, then the controller 102 may alter the power outputs or operational settings designated by the energy management system 200.

The controller 102 may re-distribute the total power requirement (e.g., 314) among the vehicles in the group 112 to increase the power output or fueling level of the vehicle 106 having the increased risk of damage from oil carryover. The controller 102 may increase the power output or operational setting designated by the energy management system 200 to prevent the vehicle 106 having the increased risk of damage from operating below the designated threshold fueling level for at least the designated time period. For example, the controller 102 may re-distribute the power requirement (e.g., 314) in the initial set 300 to the distribution of power outputs 308, 310, 312 in the revised option A set 302, to the distribution of power outputs 308, 310, 312 in the revised option B set 304, or to the distribution of power outputs 308, 310, 312 in the revised option C set 306. As shown in FIG. 3, the total power requirement 314 remains the same among all sets 300, 302, 304, 306, but the relative power outputs 308, 310, 312 of the vehicles in the group 112 changes among the different sets 300, 302, 304, 306.

In one example, the controller 102 can increase the power output 312 of the increased risk vehicle 106 from the initial designated power output 312 determined by the energy management system 200 to the increased power output 312 shown in the revised option A set 302. The controller 102 may then decrease the power output 308 and/or 310 designated for one or more of the lower or no risk vehicles (e.g., the vehicles having lower or no risks for damage from oil carryover relative to the increased risk vehicle 106). For example, to compensate for the increased power output 312 of the increased risk vehicle 106, the controller 102 may decrease one or both of the power outputs 308, 312 of the lower or no risk vehicles, as shown in the set 302. The vehicles in the group 112 may then operate at fueling levels associated with the power outputs 308, 310, 312 in the set 302 instead of the fueling levels associated with the power outputs 308, 310, 312 designated by the energy management system 200 in the initial set 300 to produce the same total power output or requirement 314.

In another example, the controller 102 can increase the power output 312 of the increased risk vehicle 106 from the initial designated power output 312 determined by the energy management system 200 to the increased power output 312 shown in the revised option B set 304. The controller 102 may then decrease the power output 308 designated for one of the lower or no risk vehicles. For example, to compensate for the increased power output 312 of the increased risk vehicle 106, the controller 102 may decrease the power output 308 of the first lower or no risk vehicle 106, as shown in the set 304. The increase in the power output 312, however, may not be sufficient to compensate for (e.g., make up for) the decrease in the power output 308. Accordingly, the controller 102 also may increase the designated power output 310 to be provided by the second vehicle 106 having a lower or no risk for damage from oil carryover, as shown in the set 304. The vehicles in the group 112 may then operate at fuel levels associated with the power outputs 308, 310, 312 in the set 304 instead of the fueling levels associated with the power outputs 308, 310, 312 designated by the energy management system 200 in the initial set 300 to produce the same total power output or requirement 314.

In another example, the controller 102 can increase the power output 312 of the increased risk vehicle 106 from the initial designated power output 312 determined by the energy management system 200 to the increased power output 312 shown in the revised option C set 306. The controller 102 may then decrease the power output 308 designated for one of the lower or no risk vehicles. For example, to compensate for the increased power output 312 of the increased risk vehicle 106, the controller 102 may decrease the power output 308 of the first lower or no risk vehicle 106, as shown in the set 306. The increase in the power output 312, however, may not be sufficient to compensate for (e.g., make up for) the decrease in the power output 308. Accordingly, the controller 102 also may increase the designated power output 310 to be provided by the second vehicle 106 having a lower or no risk for damage from oil carryover, as shown in the set 306. The vehicles in the group 112 may then operate at fueling levels associated with the power outputs 308, 310, 312 in the set 306 instead of the fueling levels associated with the power outputs 308, 310, 312 designated by the energy management system 200 in the initial set 300 to produce the same total power output or requirement 314.

In another embodiment, the vehicles that have an increased risk of damage to an engine system include vehicles that are commanded to operate at higher loads (e.g., loads above a median and/or average load or above a designated threshold load), vehicles determined to be more intolerant of high ambient temperatures, and/or vehicles determined to be more susceptible to low oxygen environments such as high altitude and tunnels than other vehicles in the group for at least a designated period of time. The designated threshold load may represent a percentage of the available power output, such as 70%, 80%, or 90% of the available power output. The damage at risk may include wear and eventual breaking of engine components, overheating and degradation of exhaust-based engine systems, and the like. In an example, the first vehicle associated with the first fueling level 308 may be identified as having an increased risk of damage to an engine system when operating at a high load (or power output) for at least a designated period of time. The power output 308 assigned to the first vehicle in the initial set 300 may be greater than the designated threshold load, so the first vehicle is identified as an increased risk vehicle. As a result, the controller 102 may decrease the power output 308 designated for the first vehicle. To compensate for the decreased power output 308 of the first vehicle, the controller 102 may increase one or both of the power outputs 310, 312 of the other vehicles that have lower or no risk of damage from operating at higher loads. For example, the controller may alter the power outputs as shown in the revised set 304 in FIG. 3. The vehicles in the group 112 may then operate at fuel levels associated with the power outputs 308, 310, 312 in the set 304 instead of the fueling levels associated with the power outputs 308, 310, 312 designated by the energy management system 200 in the initial set 300 to produce the same total power output or requirement 314. Therefore, the controller can rebalance by increasing the power outputs (or fueling levels) of the vehicles that have an increased risk of damage attributable to oil carryover and decreasing the power output (or fueling levels) of the vehicles that have an increased risk of damage due to strenuous operation at high loads, reduced oxygen, high ambient temperatures, and/or the like.

Optionally, the energy management system 200 may not designate the fueling levels or power outputs 308, 310, 312 of individual vehicles, but may determine the total power output or requirement 314 of the group 112 of the vehicles and/or of the entire vehicle system 104. For example, the energy management system 200 may determine how much total tractive effort or propulsive force (e.g., 314) is needed to propel the vehicle system 104 or group 112 of vehicles over different segments of the route 110. These efforts or forces may be determined from previous trips of the vehicle system 104 or another vehicle system 104. The efforts or forces can also be determined based on a trip plan that is generated based on characteristics of the route, the vehicles, the environmental conditions, and/or the trip. The power requirement 314 that is determined can be communicated to the controller 102, which determines the fueling levels needed from the vehicles to generate at least the power requirement 314. If these fueling levels would result in the vehicle or vehicles having the increased risk for damage from oil carryover operating below the designated threshold fueling level (e.g., idle) associated with the increased risk for at least the designated time period, then the controller 102 can re-distribute, re-allocate, or otherwise divide up the total power requirement 314 among the vehicles to prevent the vehicle or vehicles having the increased risk for oil carryover from operating at the fueling level associated with the increased risk for at least the time period. In another example, the power requirement 314 may be determined from input provided by an operator of the vehicle system 104, such as input that specifies how much power the vehicles are to provide, how fast the vehicles are to travel, etc.

Figure 4:
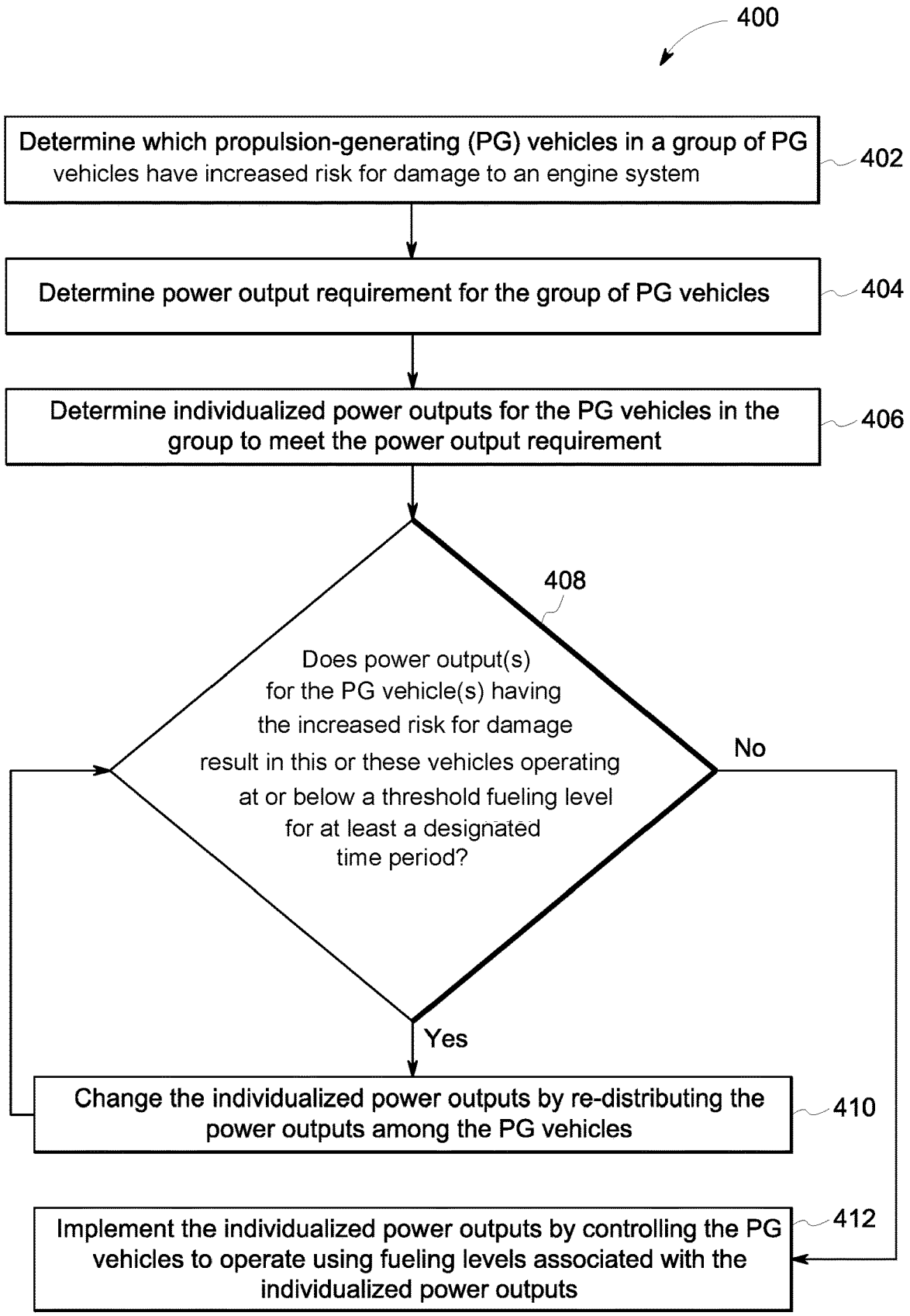
FIG. 4 illustrates a flowchart of one embodiment of a method for controlling a group of propulsion-generating vehicles.

FIG. 4 illustrates a flowchart of one embodiment of a method 400 for controlling a group of propulsion-generating vehicles. The method 400 may be used to determine the power outputs to be provided by and/or fueling levels used by propulsion-generating vehicles in the group or in a vehicle system to prevent or reduce damage that may be attributable to oil carryover, and thereby protect exhaust-based systems (e.g., EGR systems and/or aftertreatment systems). The method 400 can represent a software application or applications directing at least some of the operations of the controller 102 and/or energy management system 200 or may represent an algorithm that can be used to create such a software application or applications.

At 402, a determination is made as to which propulsion-generating vehicles in a group of propulsion-generating vehicles have an increased risk for damage to an engine system based on operation at a fueling level that is less than a designated threshold fueling level for at least a designated time period. This determination may be made by examining the input provided by an operator of the control system 100 that identifies the vehicles having exhaust-based systems, such as the EGR system 210 and/or the aftertreatment system 212. Alternatively, the memory 214 may store unique identifiers of the vehicles with data indicating which vehicles have the increased risk of damage due to oil carryover. The identifiers and data may be examined in order to determine which vehicles have the increased risk of damage.

At 404, a power output requirement for the group of the propulsion-generating vehicles is determined. This requirement may be the total power 314 needed to be generated by the vehicles in the group 112 (or in the entire vehicle system 104) to propel the group 112 and/or vehicle system 104 over or through one or more segments of the route 110. The power requirement may be determined by the energy management system 200 (as described above) or may be designated by operational settings that are dictated by the energy management system 200. For example, the operational settings dictated by the energy management system 200 may be based on a trip plan.

At 406, individualized initial power outputs for the propulsion-generating vehicles in the group are determined in order to meet (or optionally exceed) the power output requirement of the group. Different portions of the total power requirement 314 may be distributed or allocated to different vehicles in the group 112 such that the combined power outputs of the vehicles in the group 112 meet (or optionally exceed) the power output requirement 314.

In one embodiment, the energy management system 200 determines the power output requirement 314 to reduce emissions generated and/or fuel consumed by the vehicles relative to one or more other power requirements 314. The different portions of the total power requirement 314 may be distributed or allocated to different vehicles in the group 112 such that the combined power outputs of the vehicles in the group 112 meet, but do not exceed, the power output requirement 314. This can prevent the vehicles from consuming more fuel or generating more emissions (relative to exceeding the power output requirement 314).

At 408, a determination is made as to whether the power output(s) for the propulsion-generating vehicle(s) having the increased risk for damage due to oil carryover results in the vehicle(s) operating at or below a threshold fueling level for at least a designated time period. The individualized power outputs for the increased risk vehicles can be examined to determine whether implementation of these power outputs would result in the increased risk vehicles operating at an idle fueling level, for example, for at least the designated time period.

If implementation of the individualized initial power outputs would result in the increased risk vehicles operating below the threshold fueling level for at least the designated time period, then flow of the method 400 can proceed toward 410. But, if implementation of the individualized initial power outputs would not result in the increased risk vehicles operating below the threshold fueling level for at least the designated time period, then flow of the method 400 can proceed toward 412.

At 410, at least some of the individualized initial power output for the propulsion-generating vehicles in the group are changed or altered by re-distributing the power outputs among the vehicles. For example, the power output for two or more of the vehicles may be changed so that the total power requirement of the group of vehicles is still provided by a combination of the vehicles, but with the power output of two or more of the vehicles being changed relative to the previously determined power outputs. Flow of the method 400 can then return toward 408 to determine if the re-distributed power outputs would result in the increased risk vehicles operating below the threshold fueling level for at least the designated time period. This loop can continue until the distributed power outputs do not result in the increased risk vehicles operating below the threshold fueling level for at least the designated time period.

At 412, the individualized power outputs are implemented by controlling the propulsion-generating vehicles to operate using the fueling levels associated with the individualized power outputs. The controller 102 can communicate signals to the propulsion systems 202 of the vehicles to direct the propulsion systems 202 to operate using the fueling levels that cause each of the vehicles to generate the respective individualized power output.

The method 400 may be repeated one or more additional times for different locations or time periods of a current or upcoming trip of the vehicle system 104 to ensure that the vehicles having the increased risk for damage from oil carryover do not operate at too low of a fueling level (e.g., idle) for too long of a time period that would result in oil carryover occurring and damaging an exhaust-based system, such as the EGR system 210 and/or the aftertreatment system 212.

In an embodiment, a system (e.g., a vehicle control operation system) includes a controller configured to determine one or more propulsion-generating vehicles in a group of propulsion-generating vehicles that have an increased risk for damage to an engine system based on operation at a fueling level that is less than a designated threshold fueling level for at least a designated time period. The controller is further configured to determine respective power outputs for the propulsion-generating vehicles in the group such that the one or more propulsion-generating vehicles having the increased risk for damage to the engine system do not operate below the designated threshold fueling level for longer than the designated time period.

Optionally, the engine system includes one or more of an exhaust gas recirculation system, an exhaust gas aftertreatment system, an internal combustion engine, a turbocharger, a fuel system, an ignition system, and an energy storage system. During the designated time period oil in cylinders of the engine system has an increasing risk over time to be expelled from the cylinders via a flow of exhaust exiting the cylinders. Optionally, the controller is further configured to determine the one or more propulsion-generating vehicles in the group that have an increased risk for damage to the engine system by determining which propulsion-generating vehicle or vehicles in the group have one or more of an exhaust gas recirculation system or an exhaust gas aftertreatment system.

Optionally, the controller is further configured to direct the propulsion-generating vehicles in the group to each operate at one or more respective fueling levels that generate the respective power outputs and maintain the engine system damage risk at a determined level, and thereby to avoid damage to the engine system.

Optionally, the designated time period represents a period of time that the one or more propulsion-generating vehicles in the group that have an increased risk for damage to the engine system can operate at a fueling level less than the designated threshold fueling level before at least a designated amount of oil is present in exhaust exiting an engine of the one or more propulsion-generating vehicles. Optionally, the fueling level less than the designated threshold fueling level includes a transient operation in which a load on the engine system is decreased. Optionally, the fueling level less than the designated threshold fueling level includes an idle setting of an engine of the one or more propulsion-generating vehicles.

Optionally, the system further includes an energy management system configured to determine a power requirement for the group of propulsion-generating vehicles. The controller is configured to determine the respective power outputs for the group such that a combined power output generated by the group meets the power requirement.

Optionally, the system further includes an energy management system configured to assign initial power outputs for the propulsion-generating vehicles in the group. The controller is configured to determine the power outputs for the propulsion-generating vehicles in the group by altering the initial power outputs that are assigned by the energy management system. Optionally, the controller is configured to alter the initial power outputs assigned by the energy management system by increasing the respective power output assigned to the one or more propulsion-generating vehicles having the increased risk for damage to the engine system and decreasing the respecting power output assigned to at least one propulsion-generating vehicle in the group that does not have the increased risk for damage.

In an embodiment, a method (e.g., a vehicle operation method) includes determining one or more propulsion-generating vehicles in a group of propulsion-generating vehicles that have an increased risk for damage to an engine system based on operation at a fueling level that is less than a designated threshold fueling level for at least a designated time period. The method includes determining respective power outputs for the propulsion-generating vehicles in the group such that the one or more propulsion-generating vehicles having the increased risk for damage to the engine system do not operate below the designated threshold fueling level for longer than the designated time period.

Optionally, the engine system is an exhaust-based system that receives exhaust from an engine of the respective propulsion-generating vehicle. During the designated time period oil in cylinders of the engine system has an increased risk to be expelled from the cylinders via a flow of exhaust exiting the cylinders. Optionally, determining the one or more propulsion-generating vehicles in the group that have an increased risk for damage to the engine system includes determining which propulsion-generating vehicle or vehicles in the group have one or more of an exhaust gas recirculation system or an exhaust gas aftertreatment system.

Optionally, the designated time period represents a period of time that the one or more propulsion-generating vehicles in the group that have an increased risk for damage to the engine system can operate at a fueling level less than the designated threshold fueling level before at least a designated amount of oil is present in exhaust exiting an engine of the one or more propulsion-generating vehicles. Optionally, the fueling level less than the designated threshold fueling level includes an idle setting of an engine of the one or more propulsion-generating vehicles.

Optionally, the method further includes directing the propulsion-generating vehicles in the group to operate at respective fueling levels that generate the respective power outputs during movement of the propulsion-generating vehicles. Optionally, the method further includes determining a power requirement for the group of propulsion-generating vehicles based on a trip plan that designates operational settings of the propulsion-generating vehicles in the group that differ for one or more of different times or different locations during a trip of the group along one or more routes. The respective power outputs for the group are determined such that a combined power output generated by the group meets the power requirement.

Optionally, the method further includes receiving initial power outputs assigned to the propulsion-generating vehicles in the group. Determining the power outputs for the propulsion-generating vehicles in the group includes altering the initial power outputs by increasing the respective power output assigned to the one or more propulsion-generating vehicles having the increased risk for damage to the engine system and decreasing the respecting power output assigned to at least one propulsion-generating vehicle in the group that does not have the increased risk for damage.

In an embodiment, a system (e.g., a vehicle control operation system) includes a controller configured to determine if a propulsion-generating vehicle has a risk for damage to an exhaust-based system of that vehicle based at least in part on operation of the vehicle at a fueling level that is less than a designated threshold fueling level for at least a designated time period. The exhaust-based system is configured to receive exhaust from an engine of the respective propulsion-generating vehicle. The risk of damage increases over time during the designated time period. The controller is further configured to determine a respective power output for the vehicle so that the vehicle does not operate below the designated threshold fueling level for longer than the designated time period.

Optionally, the controller is further configured to determine the designated time period for the vehicle. During the designated time period oil in cylinders of the engine system has an increasing risk to be expelled from the cylinders via a flow of exhaust exiting the cylinders.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property. The above description is illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of ordinary skill in the relevant art upon reviewing the above description. The scope of the subject matter described herein is determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a controller configured to determine one or more propulsion-generating vehicles in a group of propulsion-generating vehicles that have an increased risk for damage to an engine system based on operation at a fueling level that is less than a designated threshold fueling level for at least a designated time period, wherein during the designated time period the one or more propulsion-generating vehicles in the group that have an increased risk for damage to the engine system can operate below the designated threshold fueling level without at least a designated amount of oil being present in exhaust emitted by the one or more propulsion-generating vehicles, and the controller is further configured to determine respective power outputs for the propulsion-generating vehicles in the group such that the one or more propulsion-generating vehicles having the increased risk for damage to the engine system do not operate below the designated threshold fueling level for longer than the designated time period.

2. The system of claim 1, wherein the engine system includes one or more of an exhaust gas recirculation system, an exhaust gas aftertreatment system, a turbocharger, a fuel system, an ignition system, and an energy storage system, and during the designated time period oil in cylinders of an internal combustion engine has an increasing risk over time to be expelled from the cylinders via a flow of exhaust exiting the cylinders.

3. The system of claim 1, wherein the controller is further configured to direct the propulsion-generating vehicles in the group to each operate at one or more respective fueling levels that generate the respective power outputs and maintain the engine system damage risk at a determined level, and thereby to avoid damage to the engine system.

4. The system of claim 1, wherein the controller is further configured to determine the one or more propulsion-generating vehicles in the group that have an increased risk for damage to the engine system by determining which propulsion-generating vehicle or vehicles in the group have one or more of an exhaust gas recirculation system or an exhaust gas aftertreatment system.

5. The system of claim 1, wherein the fueling level less than the designated threshold fueling level includes a transient operation in which a load on the engine system is decreased.

6. The system of claim 1, wherein the fueling level less than the designated threshold fueling level includes an idle setting of an engine of the one or more propulsion-generating vehicles.

7. The system of claim 1, further comprising an energy management system configured to determine a power requirement for the group of propulsion-generating vehicles, wherein the controller is configured to determine the respective power outputs for the group such that a combined power output generated by the group meets the power requirement.

8. The system of claim 1, further comprising an energy management system configured to assign initial power outputs for the propulsion-generating vehicles in the group, and the controller is configured to determine the power outputs for the propulsion-generating vehicles in the group by altering the initial power outputs that are assigned by the energy management system.

9. The system of claim 8, wherein the controller is configured to alter the initial power outputs assigned by the energy management system by increasing the respective power output assigned to the one or more propulsion-generating vehicles having the increased risk for damage to the engine system and decreasing the respecting power output assigned to at least one propulsion-generating vehicle in the group that does not have the increased risk for damage.

10. A method comprising:

determining one or more propulsion-generating vehicles in a group of propulsion-generating vehicles that have an increased risk for damage to an engine system based on operation at a fueling level that is less than a designated threshold fueling level for at least a designated time period, wherein during the designated time period the one or more propulsion-generating vehicles in the group that have an increased risk for damage to the engine system can operate below the designated threshold fueling level without at least a designated amount of oil being present in exhaust emitted by the one or more propulsion-generating vehicles; and determining respective power outputs for the propulsion-generating vehicles in the group such that the one or more propulsion-generating vehicles having the increased risk for damage to the engine system do not operate below the designated threshold fueling level for longer than the designated time period.

11. The method of claim 10, wherein the engine system is an exhaust-based system that receives exhaust from an engine of the respective propulsion-generating vehicle, and during the designated time period oil in cylinders of the engine has an increasing risk over time to be expelled from the cylinders via a flow of exhaust exiting the cylinders.

12. The method of claim 10, further comprising directing the propulsion-generating vehicles to operate at respective fueling levels that generate the respective power outputs during movement of the propulsion-generating vehicles.

13. The method of claim 10, wherein determining the one or more propulsion-generating vehicles in the group that have an increased risk for damage to the engine system includes determining which propulsion-generating vehicle or vehicles in the group have one or more of an exhaust gas recirculation system or an exhaust gas aftertreatment system.

14. The method of claim 10, wherein the fueling level less than the designated threshold fueling level includes an idle setting of an engine of the one or more propulsion-generating vehicles.

15. The method of claim 10, further comprising determining a power requirement for the group of propulsion-generating vehicles based on a trip plan that designates operational settings of the propulsion-generating vehicles in the group that differ for one or more of different times or different locations during a trip of the group along one or more routes, wherein the respective power outputs for the group are determined such that a combined power output generated by the group meets the power requirement.

16. The method of claim 10, further comprising receiving initial power outputs assigned to the propulsion-generating vehicles in the group, wherein determining the power outputs for the propulsion-generating vehicles in the group includes altering the initial power outputs by increasing the respective power output assigned to the one or more propulsion-generating vehicles having the increased risk for damage to the engine system and decreasing the respecting power output assigned to at least one propulsion-generating vehicle in the group that does not have the increased risk for damage.

17. A system comprising:

a controller configured to determine if a propulsion-generating vehicle has a risk for damage to an exhaust-based system of that vehicle based at least in part on operation of the vehicle at a fueling level that is less than a designated threshold fueling level for at least a designated time period, the exhaust-based system configured to receive exhaust from an engine of the respective propulsion-generating vehicle, wherein during the designated time period the one or more propulsion-generating vehicles in the group that have an increased risk for damage to the engine system can operate below the designated threshold fueling level without at least a designated amount of oil being present in the exhaust from the engine and the risk of damage to the exhaust-based system increases over time; and the controller is further configured to determine a respective power output for the propulsion-generating vehicle so that the propulsion-generating vehicle does not operate below the designated threshold fueling level for longer than the designated time period.

18. The system of claim 17, wherein the controller is further configured to determine the designated time period for the vehicle, and after the designated time period oil in cylinders of the engine is at risk of being expelled from the cylinders via a flow of the exhaust exiting the cylinders.

19. The system of claim 17, wherein the fueling level that is less than the designated threshold fueling level includes an idle setting of the engine of the propulsion-generating vehicle.

20. The system of claim 17, further comprising an energy management system configured to assign an initial power output for the propulsion-generating vehicle, and the controller is configured to determine the respective power output for the propulsion-generating vehicle by increasing the initial power output that is assigned to the propulsion-generating vehicle based on a determination that the propulsion-generating vehicle has the risk for damage to the exhaust-based system.

* * * * *